US008177059B2

(12) United States Patent
Gudmundsson

(10) Patent No.: US 8,177,059 B2
(45) Date of Patent: May 15, 2012

(54) CLOSURE ARRANGEMENT

(75) Inventor: Jonas Gudmundsson, Höllviken (SE)

(73) Assignee: Ekberg Emballage AB, Vellinge (SE)

( * ) Notice: Subject to any disclaimer, the term of this patent is extended or adjusted under 35 U.S.C. 154(b) by 382 days.

(21) Appl. No.: 11/918,923

(22) PCT Filed: Apr. 18, 2006

(86) PCT No.: PCT/SE2006/000449
§ 371 (c)(1),
(2), (4) Date: Jan. 23, 2009

(87) PCT Pub. No.: WO2006/112776
PCT Pub. Date: Oct. 26, 2006

(65) Prior Publication Data

US 2009/0212003 A1 Aug. 27, 2009

(30) Foreign Application Priority Data

Apr. 19, 2005 (SE) ..... 0500874
Jun. 15, 2005 (SE) ..... 0501367

(51) Int. Cl.
*B65D 41/04* (2006.01)

(52) U.S. Cl. ..... 206/221; 206/219

(58) Field of Classification Search ..... 206/219, 206/220, 221, 222; 215/232, 228; 220/522, 220/521
See application file for complete search history.

(56) References Cited

U.S. PATENT DOCUMENTS

| | | | | |
|---|---|---|---|---|
| 4,203,517 | A | 5/1980 | Hildebrandt et al. | |
| 4,634,003 | A * | 1/1987 | Ueda et al. | 206/221 |
| 6,138,687 | A * | 10/2000 | Sheffler et al. | 132/295 |
| 6,908,011 | B2 * | 6/2005 | Cho | 222/83 |
| 6,974,024 | B2 * | 12/2005 | Cho | 206/219 |
| 7,070,046 | B2 * | 7/2006 | Cho | 206/221 |
| 2002/0053524 | A1 * | 5/2002 | Alticosalian | 206/219 |
| 2003/0089627 | A1 * | 5/2003 | Chelles et al. | 206/219 |
| 2004/0154937 | A1 * | 8/2004 | Cho | 206/219 |
| 2004/0200740 | A1 * | 10/2004 | Cho | 206/219 |
| 2004/0200741 | A1 * | 10/2004 | Cho | 206/219 |

FOREIGN PATENT DOCUMENTS

| | | |
|---|---|---|
| DE | 2200536 | 7/1973 |
| EP | 1394064 | 3/2004 |
| JP | 49045947 | 4/1974 |
| JP | 50018846 | 6/1975 |
| JP | 05246448 | 9/1993 |
| JP | 2004244110 | 9/2004 |
| WO | WO 9325446 | 12/1993 |
| WO | WO 03086893 | 10/2003 |
| WO | WO 2004033336 | 4/2004 |

* cited by examiner

*Primary Examiner* — J. Gregory Pickett
*Assistant Examiner* — King M Chu
(74) *Attorney, Agent, or Firm* — Capitol City TechLaw

(57) ABSTRACT

The present invention concerns a closure for a container (1). The closure contains an additive to be added to the content of the container (1) at the first opening of the container (1). The closure comprises a cap (2), an insert (4) and a lid (11) covering a compartment (15) receiving the additive. The compartment (15) is defined by a doomed or conical center part (5) of the insert (4), an inner wall (14) of the cap (2) and the lid (11). The additive is added to the content of the container (1) in that the inner wall (14) of the cap (2) leaves a sealing contact with the center part (5) of the insert (4) when the cap (2) is unscrewed, giving access to openings (10) of the insert (4).

8 Claims, 1 Drawing Sheet

CLOSURE ARRANGEMENT

FIELD OF THE INVENTION

The present invention concerns a closure arrangement for a container, which closure contains an additive to be added to the content of the container.

PRIOR ART

For many products an additive should be added just before consumption or other use. The content of the container is normally in a liquid form and may be a drink, a medicine or other chemicals.

For many products a mixture formed at the time of filling may lead to shorten shelf life and other problems over time for said mixture. Such other problems may be gradual degrading, forming of deposits and color changes.

In the prior art there are a number of different types of closures having an additive to be added to the content of a container. In all these closures of prior art the user normally has to perform a special act in order for the additive to be added. If that act is not performed the additive will not be added and the content of the container may be used without the additive.

Many of the closures of the prior art have a relatively complicated structure, with parts co-operating in an intricate way. A complicated closure normally adds to the costs for manufacture of the closure.

SUMMARY OF THE INVENTION

The present invention is directed to a closure arrangement having an additive, which additive is automatically added just before use to the content of a container, on which the closure arrangement is placed. The closure functions with existing filling machines with no or only limited adaptation of the filling machine. The closure may be adapted to many different types of containers and additives in many different forms, e.g. as a powder, a tablet or a fluid.

A general object of the present invention is that the additive should be added automatically when the closure is opened. Thus, the user does not have to take any special measures.

A further object of the present invention is to have a closure which is relatively easy to produce at a low cost and which is easy to handle both in use and at filling.

Still a further object of the present invention is to facilitate placing of the additive in the closure. This is an important feature to give a relatively efficient production line.

The above objects are meet with a closure arrangement for a container, which closure arrangement comprises a cap, an insert and a lid, covering a compartment receiving the additive.

Further objects and advantages of the present invention will be obvious for a person skilled in the art when reading the detailed description below of at present preferred embodiments.

BRIEF DESCRIPTION OF THE DRAWINGS

The invention is explained further below by way of an example and with reference to the enclosed drawings. In the drawings.

DETAILED DESCRIPTION OF PREFERRED EMBODIMENTS

Figure 1:
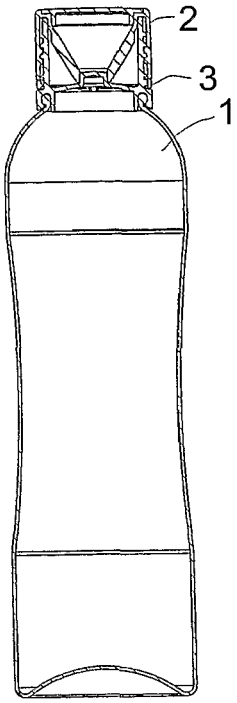
FIG. 1 is an elevation view in cross section of a container including a closure according to the present invention.

As used in this description the expressions "horizontal", "vertical" and similar expressions refers to the directions in the drawings referred to. Said directions coincide with the directions at normal use of a container having a closure.

In FIG. 1 a container 1 is shown as one example of a container on which a closure according to the present invention may be received. A person skilled in the art realizes that the actual form and size of the container may vary, as it is of no importance for the invention as such. The container 1 may be made of any material such as plastic, glass, aluminum or other metal. The closure is normally made of plastic but may be made of any suitable material. The closure received on top of the container 1 has a cap 2 and a locking ring 3. In a normal way the locking ring 3 is integrated with the cap 2 and the connection between cap 2 and ring 3 will break when the closure is first opened. To open the closure the cap 2 is screwed off in the normal way.

The closure further comprises an insert 4 received inside the cap 2. The insert 4 has a dome-formed or conic central part 5 connected via four legs 6 to an outer ring 7. The angle of inclination of the domed or conical centre part 5 of the insert 4 may be varied depending on the form of the additive. The outer ring 7 has the form of a vertical wall. On the outside of the ring 7 threads are arranged for co-operation with threads on the inside of the cap 2. The exact form of the threads or other similar connection is of no importance, as long as the closure functions in the intended way. On the lower edge of the ring 7 a groove 8 is arranged to grip a rim 9 of an opening of the container 1. Thus, the closure is attached to the container 1 by co-operation between the groove 8 of the insert 4 and the rim 9 of the container 1. The insert 4 is rigidly fixed to the rim 9 of the container 1 by means of a forced fit and/or an adhesive. In the insert 4 four openings 10 are formed between the centre part 5, the legs 6 and the ring 7. The number of legs 6 and thus the number of openings 10 formed may vary, as long as the supply of the additive is not hampered. The function of the insert 4 will be described further below.

In other embodiments (not shown) the insert is either integrated with the container or placed inside a neck of the container. The thread for co-operation with the thread of the cap 2 is placed on a neck of the container in these cases. The general forms of the inserts are the same as described above, i.e. it has a doomed central part and a number of legs connecting the central part with the rest of the container for an integrated insert or an outer ring for an insert placed inside the neck of the container. The height of the ring may vary depending on the form of connection with the container. The outer ring of the insert placed in the neck of the container is held rigidly inside the neck and at a suitable distance from the top of the neck for co-operation with the cap 2. The connection between the insert and container may have any suitable from, such as a form fit, a snap connection, a glue connection or a weld.

Figure 2:
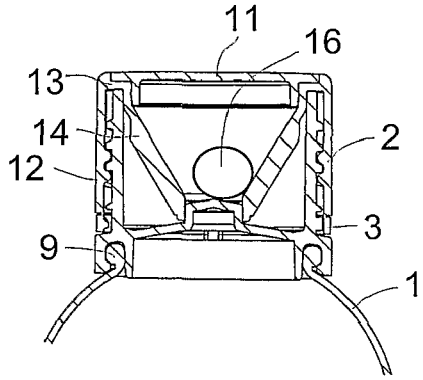
FIG. 2 is an enlarged sectional view of the closure, of FIG. 1.
Figure 3:
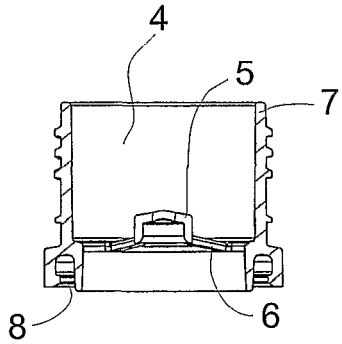
FIG. 3 is a sectional view of a part of the closure of previous Figs.
Figure 4:
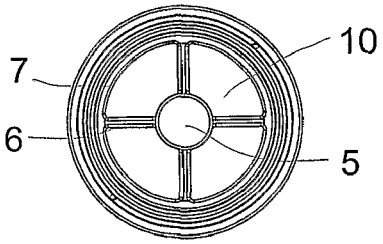
FIG. 4 is a plan view of the part of FIG. 3.
Figure 5:
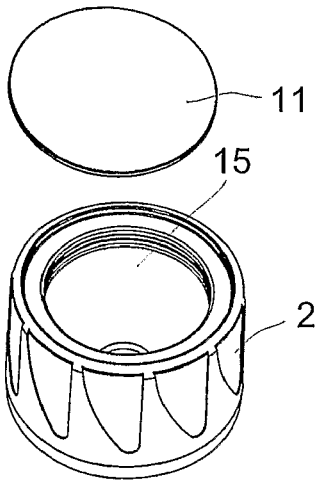
FIG. 5 is a perspective view of the closure of previous Figs.

The cap 2 is a screw cap having an annular or cylindrical wall 12 with a thread for co-operation with the thread of the insert 4. As indicated above in some embodiments the thread for co-operation with the cap is placed on the container instead. The cap 2 has an upper wall or top forming a ring 13 inside which a lid 11 is to be placed. The lid 11 is normally held by a forced fit in the ring 13. For example, the lid 11 may have a circular shape with an outer diameter that is slightly larger than the inner diameter of the ring 13. And as shown in FIG. 2, the lid 11 may have a radial outward facing surface that abuts against the cap 2, and an axial facing surface that abuts against the ring 13. A person skilled in the art realizes that the lid may be held at the ring 13 in many different ways, such as by an adhesive, a tape or by welding. To further strengthen the holding of the lid 11 at least the upper part of the cap 2, including the lid 11 may be furnished with a foil or layer of plastic, aluminum or the like. Said foil or layer is to adhere to the cap 2 and the lid 11.

Furthermore, the cap 2 has an inner, annular wall 14 placed at the inner edge of the ring 13 and directed downwards from the upper wall. In the shown embodiment the inner wall 14 is inclined inwardly, but in other embodiments the inner wall is substantially vertical. In the closure the lower end of the inner wall 14 of the cap 2 rests on the legs 6 of the insert 4. The inner wall 14 abuts the domed or conical centre part 5 of the insert 4, to form a tight fit between the cap 2 and the insert 4. Thus, a compartment 15 is formed in the closure, which compartment 15 is defined by the inner wall 14 of the cap 2, the centre part 5 of the insert 4 and the lid 11. Inside the compartment 15 an additive is to be received. In the embodiment of the Figs. the additive is formed into a tablet 16. A person skilled in the art realizes that the additive may have any form. Thus, it may e.g. also be in powder, granulate or liquid form. The compartment 15 of the closure is sealed at the bottom by the co-operation between the inner wall 14 of the cap 2 and the centre part 5 of the insert 4. A person skilled in the art realizes that the exact form of co-operation between the inner wall 14 of the cap 2 and the centre part 5 of the insert 4 may vary, as long as there is a sealing. In one embodiment beads and grooves are arranged on the different parts to give a snap function. For the alternative embodiments with the insert either integrated with the container or placed inside the neck of the container, the insert is placed at a distance from the top of the neck adapted to the height of the inner wall 14 of the cap 2.

The closure arrangement of the present invention is made of only three parts, i.e. the cap 2 including the locking ring 3, the insert 4 and the lid 11.

When the closure of the present invention is placed rigidly fixed on a container 1, and the cap 2 is screwed to open the closure, the cap 2 will rotate in relation to the insert 4. By said mutual rotation the inner wall 14 of the cap 2 will leave the contact with the legs 6 and the centre part 5 of the insert 4. As the inner wall 14 moves further upwards the tablet 16 or other additive placed in the compartment 15 of the closure will fall down through one or more of the openings 10 of the insert 4. The additive falls due to the inclined surface of the centre part 5 and gravity. Thus, the additive will fall into and mix with the content of the container 1.

A person skilled in the art realizes that the exact form and size of the closure and its different parts may be varied due to the form and size of the container and the additive. Said person also realizes that the exact form of the fixation between the insert 4 and the container 1 is of no importance, as long as the insert is rigidly fixed to the container 1.

The closure is normally fixed to the container 1 in a filling machine, directly after the container has been filled. The additive is placed in the closure either before the closure is placed on the container 1 or with the closure already placed on the container 1. The additive is normally placed inside the closure in the filling machine or in connection with the filling machine. When the additive has been placed in the opening 15 of the closure, the lid 11 is put in place, normally by being pressed into the ring 13 of the cap 2. At the same time possible further means of fixing the lid 11 to the cap 2 are applied.

The cap 2 may be screwed back onto the container 1 in a normal way after the first opening of the closure.

The invention claimed is:

1. A closure arrangement for a container, which closure arrangement is to hold an additive to be added to the content of the container at a first opening of the closure, the closure arrangement comprising:

a cap having a ring that defines an opening in the cap;

an insert received inside the cap; and a lid mounted on the ring and covering the opening in the cap, the lid having a circular shape with a radial outward facing surface that abuts against the cap and an axial facing surface that abuts against the ring;

wherein the insert has a domed or conical center part, a ring in the form of a vertical wall at a distance from the center part, at least two legs connecting the center part with the ring of the insert, and openings formed between the center part, the ring of the insert, and the legs;

wherein the insert is rigidly fixed to the container via at least one of an adhesive, a snap connection, and a weld;

wherein the cap and the insert are mutually rotatable; and wherein a closed compartment is formed, defined by an inner wall of the cap, the lid placed inside the ring of the cap, and the center part of the insert.

2. The closure of claim 1, wherein the cap comprises:

an outer, annular wall with threads for co-operation with threads of the ring of the insert; and an inner, annular wall at a distance from the outer, annular wall;

wherein the ring receiving the lid is formed between the upper edges of the outer and the inner, annular walls.

3. The closure of claim 2, wherein the inner wall of the cap abuts the center part of the insert in a closed condition.

4. The closure of claim 3, wherein the inner wall of the cap leaves the contact with the center part of the insert when the cap is unscrewed from the insert opening the closed compartment at the bottom and making it possible for the additive to fall through the openings of the insert down into the container.

5. The closure of claim 1, wherein the additive is in the form of a tablet, a powder or a fluid.

6. The closure of claim 1, wherein the lid is received inside the ring of the cap by a forced fit.

7. The closure of claim 1, wherein the lid is held at the ring of the cap by an adhesive, a tape or by welding.

8. The closure of claim 1, wherein a groove at the lower edge of the ring of the insert is adapted to be received at a rim of the container in a forced fit.

* * * * *